US008188352B2

(12) United States Patent
Bryant

(10) Patent No.: US 8,188,352 B2
(45) Date of Patent: May 29, 2012

(54) SLIDING MECHANISM FOR CHORDED ZITHER

(76) Inventor: William J. Bryant, Marion, MT (US)

( * ) Notice: Subject to any disclaimer, the term of this patent is extended or adjusted under 35 U.S.C. 154(b) by 152 days.

(21) Appl. No.: 12/822,541

(22) Filed: Jun. 24, 2010

(65) Prior Publication Data

US 2010/0326255 A1 Dec. 30, 2010

Related U.S. Application Data

(60) Provisional application No. 61/269,352, filed on Jun. 24, 2009.

(51) Int. Cl.
*G10D 3/12* (2006.01)

(52) U.S. Cl. ..... 84/285; 84/173

(58) Field of Classification Search ..... 84/173, 84/263, 264, 285–289
See application file for complete search history.

(56) References Cited

U.S. PATENT DOCUMENTS 257,808 A 5/1882 Zimmermann
523,902 A 7/1894 Muller
541,352 A 6/1895 Govan
557,290 A 3/1896 Sucker
566,388 A 8/1896 Eschemann
591,729 A 10/1897 Behnke
593,126 A 11/1897 Roth
634,142 A 10/1899 Heyman
659,429 A 10/1900 Almcrantz
753,867 A * 3/1904 Ford ..... 84/287
1,097,048 A 5/1914 Reynolds
2,401,571 A 6/1946 Konter
3,515,026 A 6/1970 Rohrbough

* cited by examiner

*Primary Examiner* — Kimberly Lockett
(74) *Attorney, Agent, or Firm* — Thomas E. Loop; Graybeal Jackson LLP

(57) ABSTRACT

An improved chorded zither is disclosed herein which may be characterized in that it comprises a novel adjustably positionable chord bar assembly (which assembly enables the playing of every key in the normal chromatic scale of 12 keys). In a preferred embodiment, the inventive chord bar assembly comprises a slidable chord bar rack operably connected to a plurality of chord bars, with the chord bar rack being interposed between the top surface of a body and a plurality of strings (associated with a stringed musical instrument). The plurality of chord bars is positioned above chord bar rack and perpendicular relative to the plurality of tensioned strings. The chord bar assembly is configured to be adjustably positionable between at least a set up key position, a sharpened key position, and a flatted key position.

2 Claims, 4 Drawing Sheets

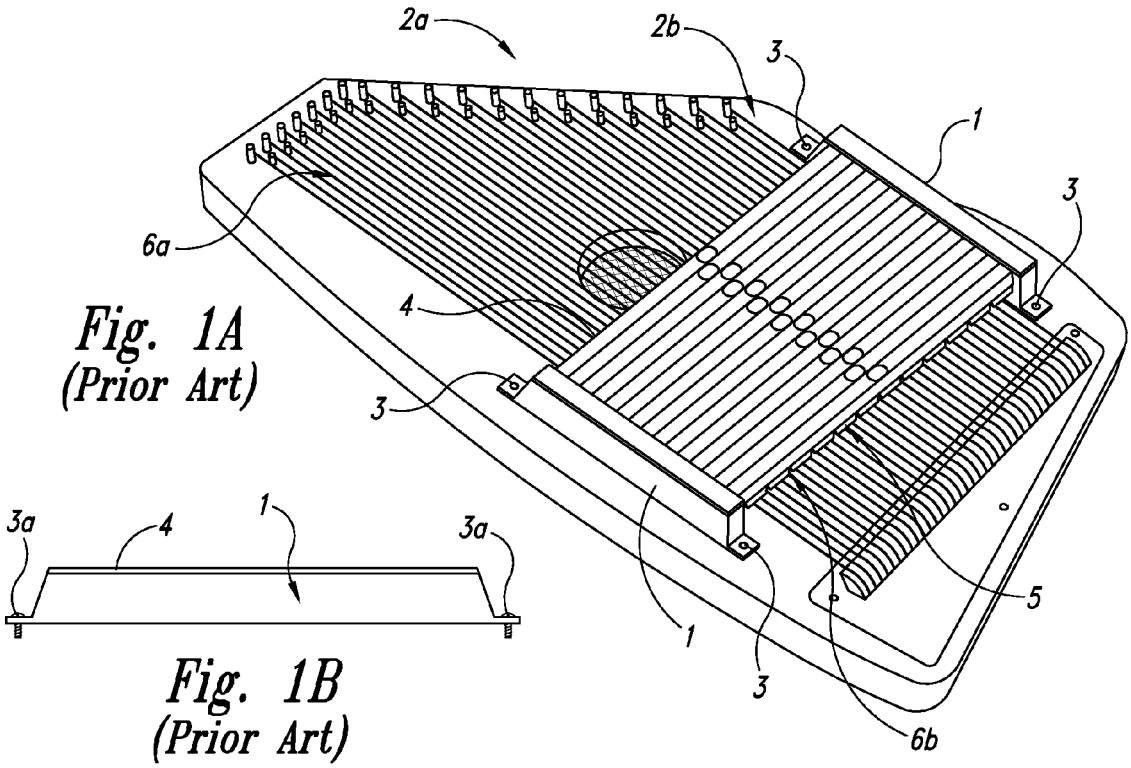
Fig. 1A
(Prior Art)
Fig. 1B
(Prior Art)
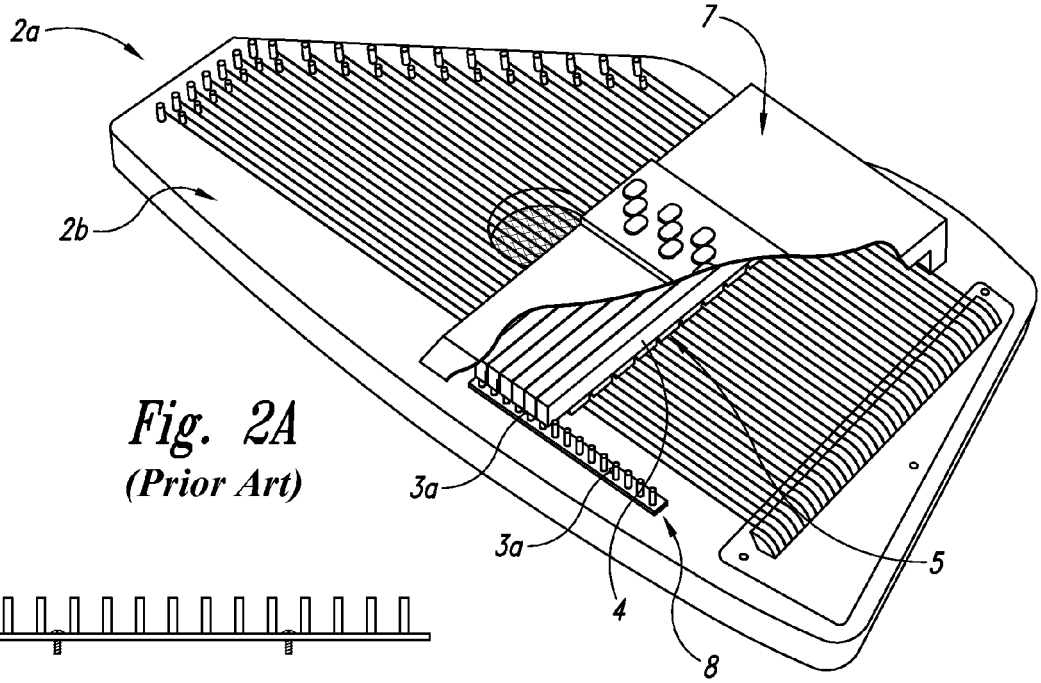
Fig. 2A
(Prior Art)
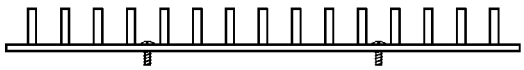
Fig. 2B
(Prior Art)

SLIDING MECHANISM FOR CHORDED ZITHER

CROSS-REFERENCE TO RELATED APPLICATIONS

This application claims the benefit of priority to U.S. Provisional Application No. 61/269,352 filed on Jun. 24, 2009, which application is incorporated herein by reference in its entirety for all purposes.

TECHNICAL FIELD

The present invention relates generally to musical instruments and, more particularly, to stringed musical instruments such as zithers and autoharps.

BACKGROUND OF THE INVENTION

For purposes of background, a "zither" is a specialized type of chorded or stringed musical instrument. More specifically, zithers include any one of several stringed musical instruments that consist of a flat, shallow resonator box (sets horizontally before the performer when in use) overlaid with a multiplicity (e.g., 20 to 40) of strings (also commonly referred to as "chords"). The strings nearest the performer when in use run above a fretted fingerboard against which they are stopped by the left hand to provide melody notes. The strings are generally plucked by a plectrum worn on the right thumb. At the same time, the right hand fingers pluck an accompaniment on the farther strings, which remain unstopped. The zither is capable of playing notes arranged in a series of octaves.

An "autoharp" is generally considered to be a specialized type of zither on which a simple harmony may be obtained by button-controlled dampers (operating in sets) that when depressed leave free the strings of the desired chord. U.S. Pat. No. 257,808 to Zimmermann discloses the original autoharp. More specifically, U.S. Pat. No. 257,808 teaches a musical instrument having a multiplicity of strings arranged in a number of octaves over a resonating box, wherein a series of chord bars are provided together with a series of dampening pads which engage selected strings when the chord bar is depressed. Thus, only certain of the strings are free to vibrate or give sound when strummed or picked. Further, the dampening is generally selected such that when a particular chord bar is depressed only those selected strings which constitute the notes in that chord are free to vibrate.

Manufactured and luthier-built autoharps generally have up to 21 spring-loaded or flexible levered chord bars rigidly fastened to the body of the autoharp, producing from one to five keys. Because the chord bars remain in a fixed position relative to the underlying strings, it difficult to play songs in keys the autoharp does not have. Accordingly, there is a need in the art for new and improved stringed musical instruments (including zithers and autoharps) that enable the playing of every key in the normal chromatic scale of 12 keys. In addition, there is a need in the art for stringed musical instrument retrofit kits that enable luthiers to modify existing stringed musical instruments (including zithers and autoharps) such that existing chord bars may be adjustably positionable relative to the underlying strings. The present invention fulfills these needs and provides for further related advantages.

SUMMARY OF THE INVENTION

In brief, the present invention in an embodiment is directed to a stringed musical instrument that comprises a body; a plurality of laterally spaced apart tensioned strings connected to the body, the tensioned strings being positioned above and across a top surface; and an adjustably positionable chord bar assembly connected to the body. In this embodiment, the chord bar assembly comprises a slidable chord bar rack operably connected to a plurality of chord bars, with the chord bar rack being interposed between the top surface of the body and the plurality of strings. The plurality of chord bars is positioned above chord bar rack and perpendicular relative to the plurality of tensioned strings. In this configuration, the chord bar assembly is adjustably positionable between at least a set up key position, a sharpened key position, and a flatted key position.

The inventive chord bar assembly may further comprise a pair of upwardly extending combs rigidly connected to either end of a sliding plate. The sliding plate is configured to be movable back and forth in a direction perpendicular to the plurality tensioned strings. Each upwardly extending comb has a plurality of laterally spaced apart pins, and each of the plurality of chord bars has pin receiving holes at each end. Each of the plurality of receiving pins is received into each respective pin receiving hole.

In another embodiment, the present invention is directed to an adjustably positionable chord bar rack assembly configured for attachment to a body of a stringed musical instrument. In this embodiment, the chord bar rack assembly is adjustably positionable between at least a set up key position, a sharpened key position, and a flatted key position when connected to the body of a stringed musical instrument. The chord bar rack assembly comprises: a pair of combs, with each comb having a plurality of laterally spaced apart and outwardly extending pins, the plurality of pins being configured to receive a plurality of corresponding pin receiving holes, with each of the plurality of corresponding pin receiving holes being positioned at an end of a chord bar of a plurality of chord bars; a sliding plate having a bass end and a treble end, the sliding plate being connected to the pair of combs at the bass and treble ends; a governor plate connected to the sliding plate at the bass end, the governor plate being configured for attachment to the body of the stringed musical instrument; a guide plate connected to the sliding plate at the treble end, the guide plate being configured for attachment to the body of the stringed musical instrument; and a governor body connected to the sliding plate at the bass end, the governor body being configured to selectively engage the governor plate to thereby prevent movement of the sliding plate relative to the positions of the governor and guide plates when attached to the body of the stringed musical instrument and to allow adjustable positioning between at least the set up key position, the sharpened key position, and the flatted key position.

These and other aspects of the present invention will become more readily apparent to those possessing ordinary skill in the art when reference is made to the following detailed description in conjunction with the accompanying drawings.

BRIEF DESCRIPTION OF THE DRAWINGS

The drawings are intended to be illustrative and symbolic representations of certain exemplary embodiments of the present invention and as such they are not necessarily drawn to scale. In addition, and for purposes of clarity, like reference numerals have been used to designate like features throughout the several views of the drawings.

FIG. 1 illustrates a side perspective view of a chorded zither having a conventional stationary chord bar rack of a first style in accordance with the prior art.

FIG. 2 illustrates a side perspective view of a chorded zither having a conventional stationary chord bar rack of a second style in accordance with the prior art, wherein the cover is shown in partial view so that the underlying chord bar components can be seen.

DETAILED DESCRIPTION OF THE INVENTION

Figure 3A:
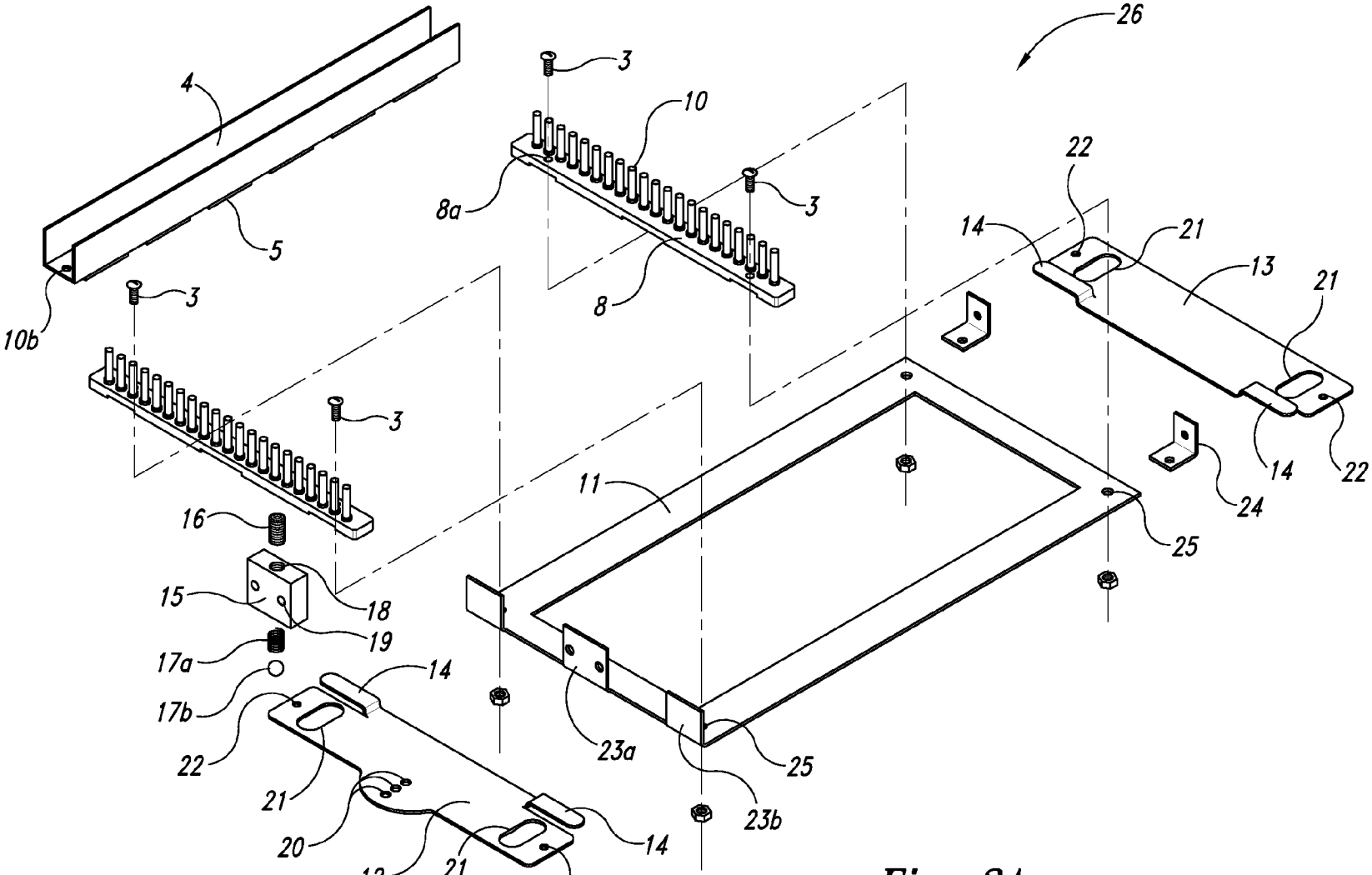
FIG. 3*a* illustrates an exploded side perspective view of an adjustably positionable chord bar rack in accordance with an embodiment of the present invention.

In order to aid in the understanding of the present invention, I first provide a short explanation of the two styles of "chord bar racks" commonly used in connection with prior art zithers and autoharps. Thus, and referring first to FIG. 1 (prior art), there is shown a first of two basic styles of known chord bar racks, which first style of chord bar rack is rigidly connected to the resonator box (body) of a common autoharp. Although there can be any number of chord bars connected to the autoharp body, I choose fifteen bars for purposes of illustration. As shown, two end racks 1 are securely fastened to the body 2*b* of the autoharp 2*a* by means of two wood screws 3*a* at each end. The two end racks 1 are configured to hold a plurality individual chord bars 4 (wherein each chord bar is of the flexible levered variety the mechanics of which are not shown in detail). When an individual chord bar 4 is pressed, the felt 5 below mutes the string(s) 6*a* it contacts. The open spaces 6*b* allow that string 6*a* to resonate to thereby produce a sound. All the open spaces 6*b* create, in unison, a chord. Because the two end racks 1 are rigidly fixed to the body 2*b* of the autoharp 2*a*, only that one designated chord is available for play on that one chord bar 4.

Referring next to FIG. 2 (prior art), there is shown a second of two basic styles of known chord bar racks. In this alternative configuration, a cover 7 partially hides some of the underlying mechanisms of the stationary chord bar rack. As shown, instead of two end racks 1 holding the individual chord bars 4, two upwardly extending combs 8 hold the individual chord bars 4 (wherein the chord bars have pin receiving holes 10*b* at each end and are of the spring-loaded variety the mechanics of which are not shown in detail) that slide over the pins 10*b* of the combs 8. The combs 8 have two holes 8*a* to fasten it directly to the body 2*b* of the autoharp 2*a* by means of two wood screws 3*a* at each end. Again, the chord bars 4 do not move relative to the position of the underlying strings 6*a*, and are thus limited to the playing of only one chord.

Figure 3B:
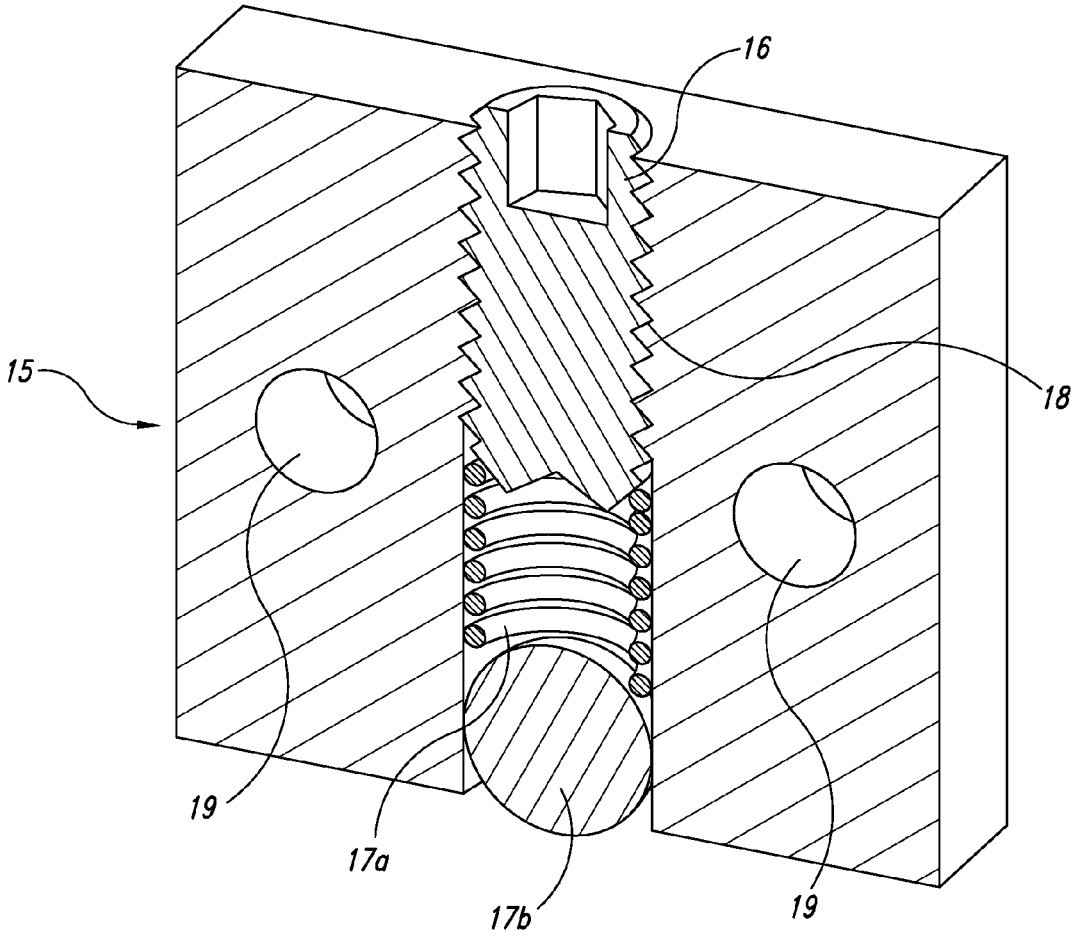
FIG. 3*b* illustrates an enlarged view of the governor body component of the adjustably positionable chord bar rack of FIG. 3*a*.

In view of the foregoing, FIG. 3*a* shows an exploded view of an embodiment of my invention. For purposes of convenience, I choose to expound on a 21 chord system (corresponding to a zither or autoharp having a plurality of strings) so that various details of my invention may be more readily appreciated by those of ordinary skill in the art. Thus, and in this regard, an important feature of my invention is to fasten the combs 8 and/or the end racks 1 (of a conventional zither or autoharp) to a movable sliding plate 11, which plate 11 is configured to be adjustably positionable relative to the strings 6*a* of the stringed musical instrument. The sliding plate 11 is fastened to a governor plate 12 at the bass end, and to a guide plate 13 at the treble end, both of which have formed tabs 14 that the sliding plate 11 is affixed under. As shown, the formed tabs 14 limit the distance the sliding plate 11 can travel in either direction. Attached to the sliding plate 11 is the governor body 15 (best seen in FIG. 3*b*), which contains an allen screw 16, a spring 17*a*, a ball-bearing 17*b*, a threaded and counterbored hole from top to bottom 18 and two holes 19 for fastening to the sliding plate 11. The governor body 15 is adjustably positionable over holes 20 on the governor plate 12, thereby allowing the ball-bearing 17*b* to snap into a selected hole 20 as the cover 7 (not shown) is pushed by hand in either direction.

Although only three holes 20 are needed to achieve all keys, any number could be implemented for more varied chord patterns or other configurations. As shown, both the governor plate 12 and the guide plate 13 have large, oval openings 21 to allow the necessary fastener 3*b* holding the comb 8 and/or the end rack 1 to the sliding plate 11 to move freely. Two smaller holes 22 fasten the governor plate 12 and the guide plate 13 securely to the body 2*b* of the autoharp 2*a*. The center tab 23*a* holds the governor body 15 securely to the sliding plate 11. The two tabs 23*b* at the bass end of the sliding plate 11 hold the bass end of the cover 7 (not shown) in place, while the two unattached brackets 24 hold the cover 7 (not shown) at the treble end in place. Four holes 25 on the sliding plate 11 are for holding the combs 8 in place.

Figure 4:
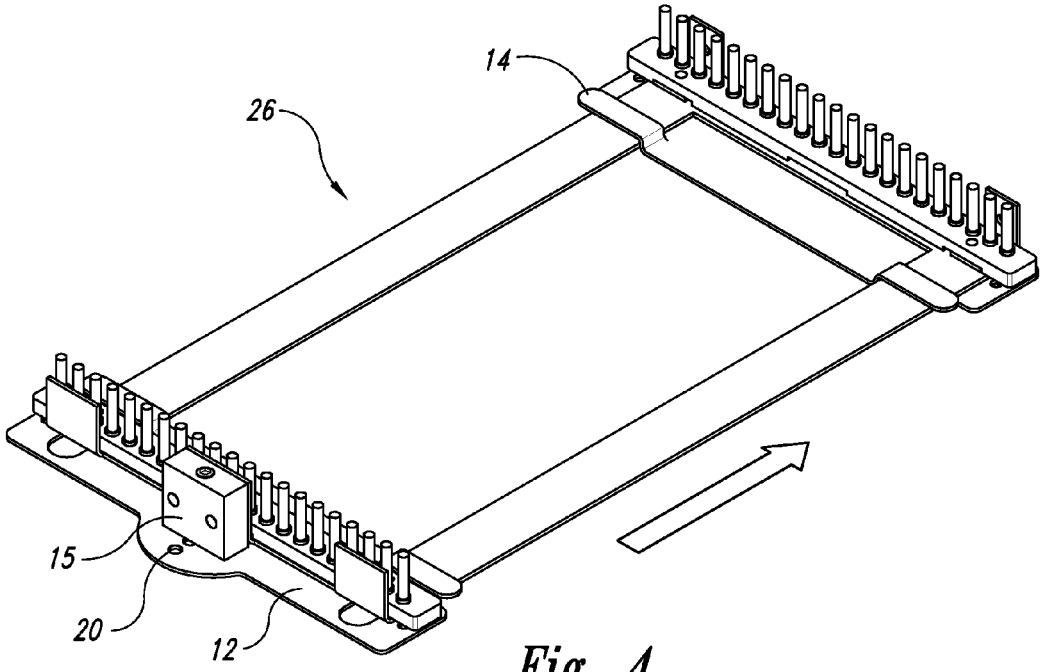
FIG. 4 illustrates the adjustably positionable chord bar rack of FIG. 3*a*, but where the adjustable chord bar rack is in the sharpened positioned in accordance with an embodiment of the present invention.
Figure 5:
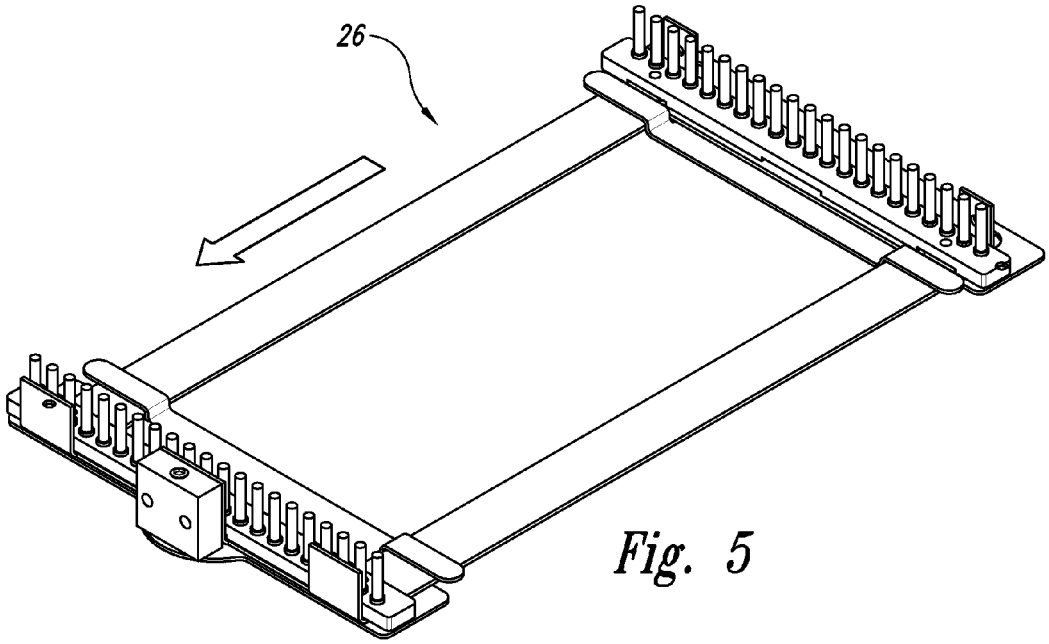
FIG. 5 illustrates the adjustably positionable chord bar rack of FIGS. 3*a* and 4, but where the adjustable chord bar rack is in the flattened position in accordance with an embodiment of the present invention.

FIG. 4 shows the entire chord bar rack assembly 26 together (which I call the "chromaslide") and adjustably positioned to be in the sharpened position, whereas FIG. 5 shows the assembly 26 adjustably positioned to be in the flatted position. When the assembly 26 is in the middle position, it will be setting over the middle hole 20 on the governor plate 12 (i.e., ball-bearing 17*b* snapped into the center hole 20), and all chord bars 4 will be in the original keys set up position. Thus, the chord bars 4 stay in the same relative positions no matter what key the autoharp 2*b* is in.

The proper method for using my "chromaslide" is to have the adjustably positionable chord rack assembly 26 located in the middle position to play the keys it was set up for, for example, "A", "D", "G", "C" and "F". The top row (for explanation only) would contain the relative seventh chords to those major keys, while the bottom rows (again, for explanation only) would contain the minor chords relative to those major keys. When the cover 7 is pushed towards the bass side of the autoharp 2*b*, all chords are moved down one half note. Now the major keys are "Ab", "Db", "Gb", "B" and "E", and all other chords will follow suit. If the cover 7 is pushed up to the treble side from the center position, all chords will be moved up one half note. Now, the major keys are "Bb", "Eb", "Ab", "Db" and "Gb". Again, all other chords in this position will follow the major chords. The keys and chords listed are for purposes of illustration only, as any arrangement could be used. Other examples of using this "chromaslide" would be pairing chords to create other chords, or adding many elaborate chords, sacrificing the number of keys, for the playing of more complicated pieces. The assembly 26 could be moved, for example, during the playing of a song, but must be done carefully, so the felts 5 are not stressed by the strings 6*a* causing them to pull loose.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

I claim:

1. An adjustably positionable chord bar rack assembly configured for attachment to a body of a stringed musical instrument, the chord bar rack assembly being adjustably positionable between at least a set up key position, a sharpened key position, and a flatted key position when connected to the body of a stringed musical instrument, the chord bar rack assembly comprising:

a pair of combs, with each comb having a plurality of laterally spaced apart and outwardly extending pins, the plurality of pins being configured to receive a plurality of corresponding pin receiving holes, with each of the plurality of corresponding pin receiving holes being positioned at an end of a chord bar of a plurality of chord bars;

a sliding plate having a bass end and a treble end, the sliding plate being connected to the pair of combs at the bass and treble ends;

a governor plate connected to the sliding plate at the bass end, the governor plate being configured for attachment to the body of the stringed musical instrument;

a guide plate connected to the sliding plate at the treble end, the guide plate being configured for attachment to the body of the stringed musical instrument; and a governor body connected to the sliding plate at the bass end, the governor body being configured to selectively engage the governor plate to thereby prevent movement of the sliding plate relative to the positions of the governor and guide plates when attached to the body of the stringed musical instrument and to allow adjustable positioning between at least the set up key position, the sharpened key position, and the flatted key position.

2. The adjustably positionable chord bar rack assembly of claim 1 wherein the governor body includes an outwardly facing spring-loaded ball bearing, and wherein the governor body includes a plurality of ball bearing receiving holes corresponding to at least the set up key position, the sharpened key position, and the flatted key position, and wherein the spring-loaded ball bearing is configured to fit into one of the plurality of ball bearing receiving holes.

* * * * *